US009765978B2

(12) United States Patent
Billings

(10) Patent No.: US 9,765,978 B2
(45) Date of Patent: Sep. 19, 2017

(54) LOW WATER SENSOR TESTING DEVICE

(71) Applicant: Craig W. Billings, Pittsford, VT (US)

(72) Inventor: Craig W. Billings, Pittsford, VT (US)

( * ) Notice: Subject to any disclaimer, the term of this patent is extended or adjusted under 35 U.S.C. 154(b) by 0 days.

(21) Appl. No.: 14/998,785

(22) Filed: Feb. 17, 2016

(65) Prior Publication Data

US 2017/0234551 A1 Aug. 17, 2017

(51) Int. Cl.

| | |
|---|---|
| ***F22B 37/44*** | (2006.01) |
| ***F24D 19/10*** | (2006.01) |
| ***F24D 19/08*** | (2006.01) |

(52) U.S. Cl.

CPC ..... *F24D 19/1009* (2013.01); *F22B 37/44* (2013.01); *F24D 19/088* (2013.01); *F24D 2240/22* (2013.01); *Y10T 137/87917* (2015.04)

(58) Field of Classification Search

CPC .... F24H 9/20; F24D 19/1009; F24D 19/1006; Y10T 137/87917; F22B 37/44

USPC ..... 137/393

See application file for complete search history.

(56) References Cited

U.S. PATENT DOCUMENTS

| | | | | |
|---|---|---|---|---|
| 3,834,357 | A | 9/1974 | Kaczmarek et al. | |
| 4,066,858 | A | 1/1978 | Piper et al. | |
| 4,274,390 | A | 6/1981 | Azuma | |
| 4,465,088 | A | 8/1984 | Vosper | |
| 4,556,168 | A | 12/1985 | Romanow et al. | |
| 4,727,826 | A | 3/1988 | Draper et al. | |
| 5,076,321 | A | 12/1991 | Terry | |
| 5,582,236 | A | 12/1996 | Eike et al. | |
| 5,671,771 | A | 9/1997 | Brandel | |
| 6,073,591 | A | 6/2000 | Theriault | |
| 6,964,278 | B2 | 11/2005 | Tschanz | |
| 7,409,301 | B2 | 8/2008 | Tynkov | |
| 7,681,596 | B2 * | 3/2010 | Reck | F16K 5/0605 137/625.47 |
| 7,789,106 | B2 * | 9/2010 | Reck | F16K 11/0873 137/625.47 |
| 7,802,430 | B1 | 9/2010 | Sha | |
| 7,954,506 | B2 | 6/2011 | Swan | |
| 7,992,527 | B2 | 8/2011 | Merwin | |
| 8,091,793 | B2 | 1/2012 | Kempf et al. | |
| 8,108,953 | B2 | 2/2012 | Zeng | |
| 2010/0280665 | A1 | 11/2010 | Fildes et al. | |
| 2013/0200168 | A1 | 8/2013 | Buescher et al. | |
| 2015/0028120 | A1 * | 1/2015 | Olsen et al. | F16K 11/22 237/62 |

FOREIGN PATENT DOCUMENTS

| | | |
|---|---|---|
| GB | 793512 | 4/1958 |

* cited by examiner

*Primary Examiner* — Kevin Lee

(74) *Attorney, Agent, or Firm* — John J. Welch, Jr., Esq.

(57) ABSTRACT

A low water sensor testing device having an initial piping unit connected to a hot water boiler and also connected to a first three way purge valve unit, which valve unit is, in turn, connected to a T-shaped piping unit and affixed within the stem portion of which there is a low water level sensor unit with the T-shaped piping unit being further connected to a second three way purge valve unit, wholly equivalent to the first valve unit, with the second valve unit being connected to an adapter unit, in turn, also connected to outflow piping carrying boiler heated water via outflow piping to the heating system of a residential or commercial structure.

12 Claims, 18 Drawing Sheets

LOW WATER SENSOR TESTING DEVICE

PRIOR OR PARENT APPLICATIONS

There are no prior or parent applications as relate to the herein described invention.

FEDERALLY SPONSORED RESEARCH AND DEVELOPMENT

There is no federally sponsored research or development as relates to the herein described invention.

BACKGROUND OF THE INVENTION

A: Field of the Invention

The invention relates to those devices serving to test for low water levels in hot water boiler units that operate to provide heat within residential and commercial buildings.

B: Prior Art

There is no prior art known to Applicant that anticipates the present invention. The herewith submitted Informational Disclosure Statement reflects art that is within the field of the invention but which does not anticipate it.

SUMMARY OF THE INVENTION

A: A Brief Description of the Invention

The invention consists of an initial piping unit being elongated hollow piping with external threading found at each end thereof. The first end of this component is threadably connected to internal threading found within the outflow hole of a hot water boiler. The second end is threadably connected to internal threading found within the first end cavity of the first of a pair of three way purge fluid isolation valve units. A hollow T-shaped piping unit via external threading about the first end portion thereof is threadably connected to internal threading found within the second end cavity of the first purge valve unit. The second end portion of the T-shaped piping unit via external threading thereabout is threadably connected to the second of the pair of three way purge fluid isolation valve units via internal threading found within the second end cavity of the second purge valve unit. The stem portion of the T-shaped piping unit is partially hollow and partially solid and is featured by the presence of an internally/threaded through hole found within the solid base section thereof. The internally threaded through hole serves to accept a cylindrically shaped, externally threaded sensor unit that also fits through a hole in the crossbar portion of the T-shaped piping unit. The first end cavity of the second purge valve unit also features internal threading which is amenable to receipt of the externally threaded first end portion of a hollow adapter unit. The second end portion of the adapter unit is amenable to being press fitted, soldered or welded to the proximal end portion of outflow piping leading to the heating system located within a building structure within which the hot water boiler is located.

B: Object of the Invention

It is well known that low water levels within the innards of a hot water boiler unit can beget catastrophic consequences for the owners of such a unit. Such low water levels can occur, for example, in instances where a feeding valve permitting the flow of water into such a unit becomes defective, i.e., notably, partially shut. Such low water levels will ultimately serve to prompt the formation of steam within the inner region of the boiler unit, steam that once having accumulated to a sufficient volume can then prompt an explosion of the boiler unit. For this reason, such boiler units also have emergency relief valves that are triggered in the event of the presence of excess steam within the unit. Such triggering however invariably results in steam and water damage about the exterior region of the boiler unit. For this reason, boiler units are also equipped with low water sensor systems. Such sensor systems consist of an electro-sensor component unit, the end sensor portion of which is located within the outflow water piping conjoined with and leading from the boiler unit. The sensor system features a low water cut off switching device. The switching device serves to shut off power to the boiler unit, in effect shutting it down, once it would have developed that the water level within the operating boiler unit would have become low enough to cause steam to commence notably forming within the boiler unit in the event that the boiler unit were to otherwise remain so powered up. Low water within the boiler unit is reflected by a lack of water within the outflow piping leading from the boiler to the zones of heating within the structure served by the boiler, to wit, no water accordingly found in the vicinity of the sensor unit positioned within said outflow piping. Such a low water event causes activation of the sensor, if properly functioning, which in turn operates to shut down power to the boiler unit thereby obviating continued heating of any water found within the boiler unit which in turn prevents the continuing development of any steam within the boiler unit.

However, there are times when the sensor unit itself may be defective, non-operable to the extent that any such low water level would accordingly go undetected say, at times when the building or dwelling, within which the boiler unit is located, remains wholly unoccupied. Such inoperability would lead to continuous steam build up in the event of low water levels within the boiler unit leading to one or potentially more continuous blow off of steam and concomitantly progressive water damage about the exterior portion of the boiler unit, or, much worse, an explosion, in the event that, for whatever reason, the relief valve system serving the boiler would, likewise, itself, somehow, be then defective as well.

In view of the foregoing, it is necessary to periodically test the integrity of the low water sensor unit serving the boiler. Such testing is however currently cumbersome and clearly very time consuming. To begin with, such testing requires drainage of the water, all of the water within the heating system within the building housing the boiler. This takes a goodly amount of time to accomplish, and; then, with such drainage, once the water level within the boiler recedes sufficiently, the sensor unit will be triggered, and; the boiler will be powered off, provided that the sensor unit is then properly functioning. If, on the other hand, the sensor unit is not then properly functioning, the boiler unit will continue to run in the absence of sufficient water within the boiler, thereby indicating that the sensor unit is, itself defective and accordingly in need of repair or replacement. At any rate, once the integrity of the sensor unit will have been evaluated, then, either repaired, replaced or, if properly functioning, then; simply left alone, it then becomes necessary to bring about a refilling of the whole of the water content within the whole of the heating system within the building, involving yet more time and effort on the part of the persons charged with so testing the integrity of the sensor unit. Such doings also require at least two persons expending numerous hours in terms of the time required in an effort to accomplish such testing.

The present invention, on the other hand, serves to provide a very simple, quick and ready means for so testing the integrity of a low water sensor unit. Outflow piping equipped with the invention readily facilitates such simple, quick and ready testing by only one person and within a space of, at most, only a few minutes of time.

For the foregoing reason alone, the present invention is not merely new and unique but indeed unquestionably useful.

A DESCRIPTION OF THE DRAWINGS

A DESCRIPTION OF THE EMBODIMENTS OF THE INVENTION

Figure 1:
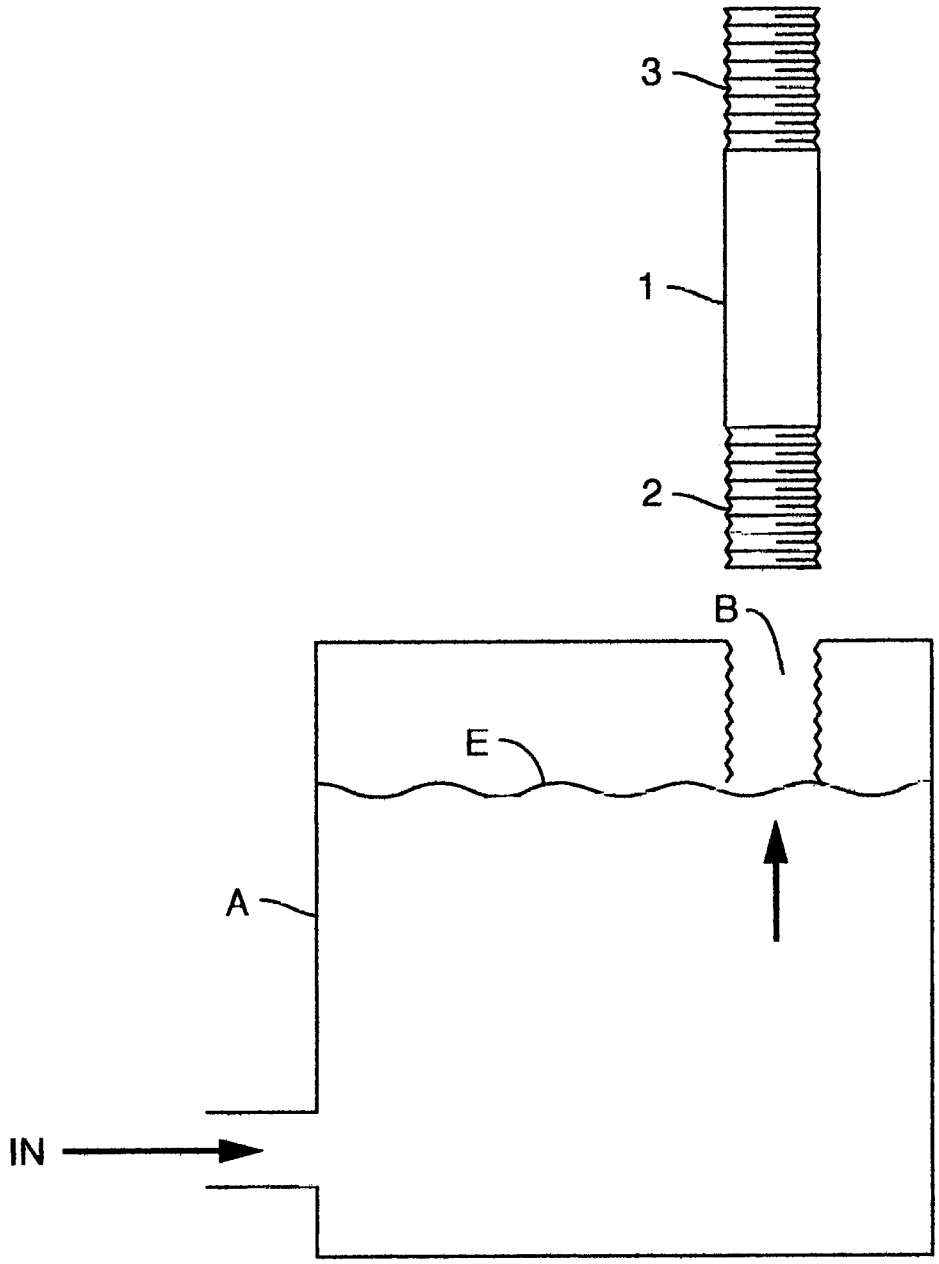
FIG. 1 shows in plan view, a boiler with an internally threaded topside hole in apposition to the first piping component of the initial piping unit of the first embodiment of the invention.

The invention for a first embodiment thereof features an initial piping unit being a hollow first piping component 1 with an externally threaded first end 2 and an externally threaded second end 3. The invention for a second embodiment thereof also features an initial piping unit but being an ancillary piping component 21 connected to an elbow shaped fitting component 24 in turn connected to a first piping component 1. The invention also features a pair of three way purge fluid isolation valve units 4, each having an internally threaded first end cavity portion 5 and an internally threaded second end cavity portion 6. Such fluid isolation valve units also typically feature valve handles 27, 28 internally connected to water stop elements 29, 31 respectively as more particularly referenced below. There is also a T-shaped piping unit 7 with a hollow crossbar portion 8 and a partially hollow stem portion 9. Crossbar portion 8 has an externally threaded first end segment 10 and an externally threaded second end segment 11. Crossbar portion 8 is also characterized by the presence therein of a through hole 12. Stem portion 9 has a solid base section 13 within which there is found an internally threaded hole 14. Finally, the invention features an adapter unit 15 which is hollow throughout. A first end portion 16 thereof is externally threaded. The second end portion 17 is not threaded either internally or externally. Second end portion 17 is also amenable to receipt therein of an optional O-ring unit 18.

Figure 2:
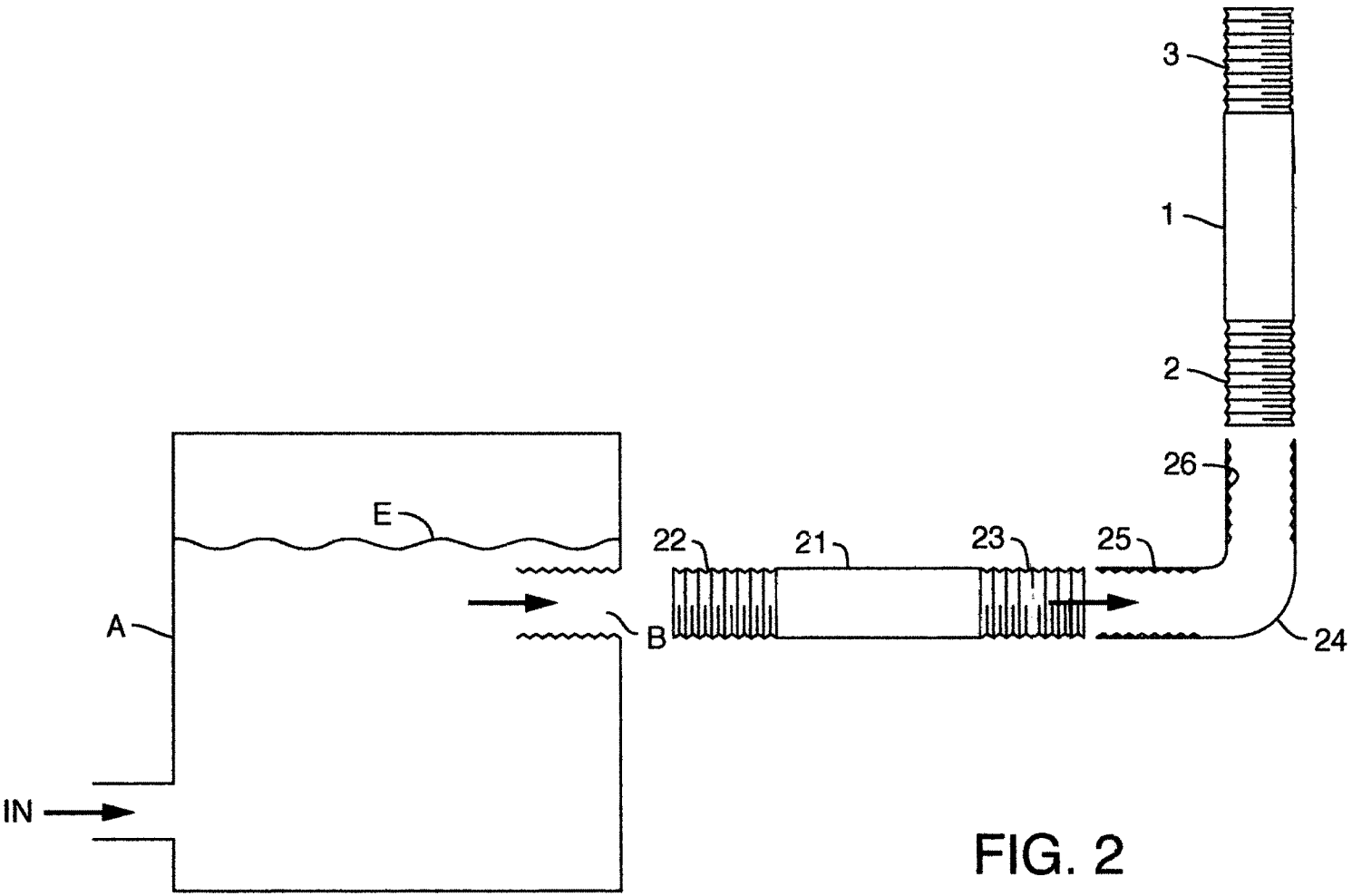
FIG. 2 shows in plan view a boiler with an internally threaded lateral side hole in apposition to the ancillary piping component of the initial piping unit of the second embodiment of the invention.
Figure 3:
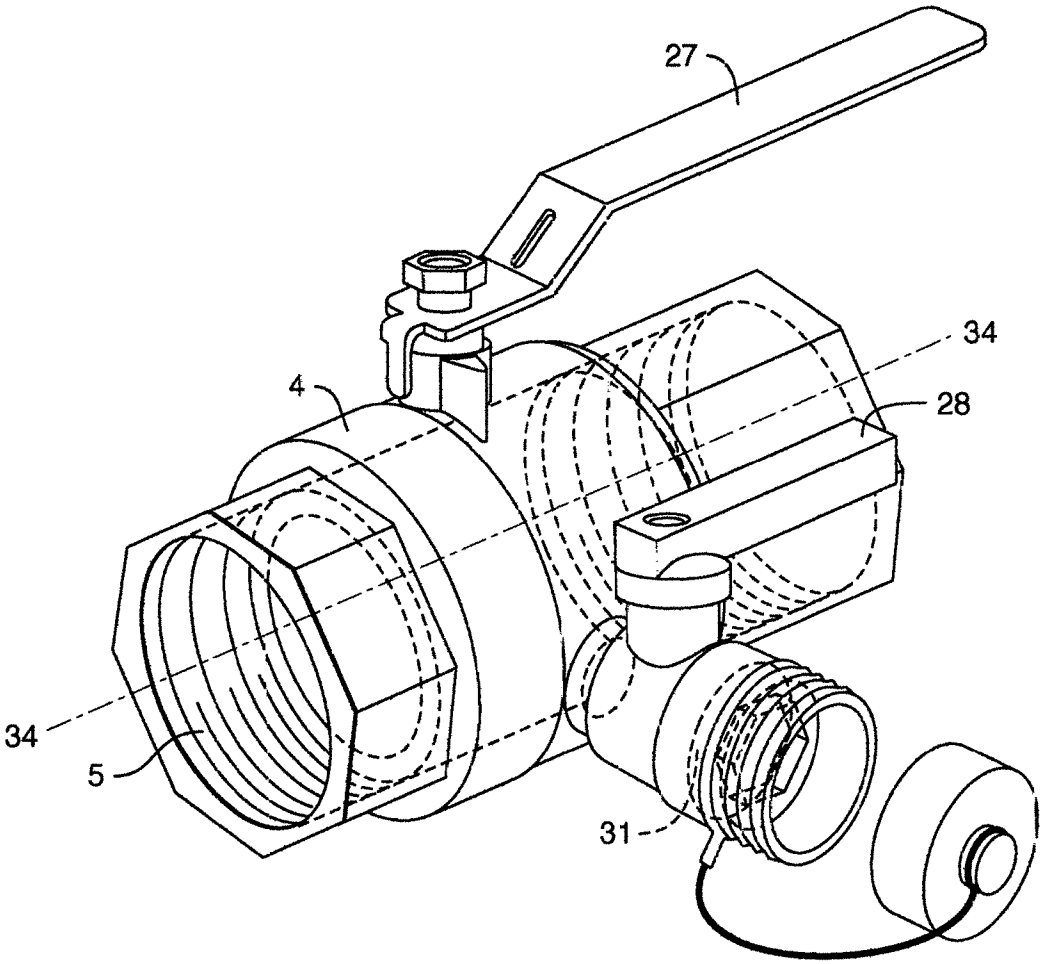
FIG. 3 shows a first perspective view of the first three way purge fluid isolation valve unit of the invention.
Figure 4:
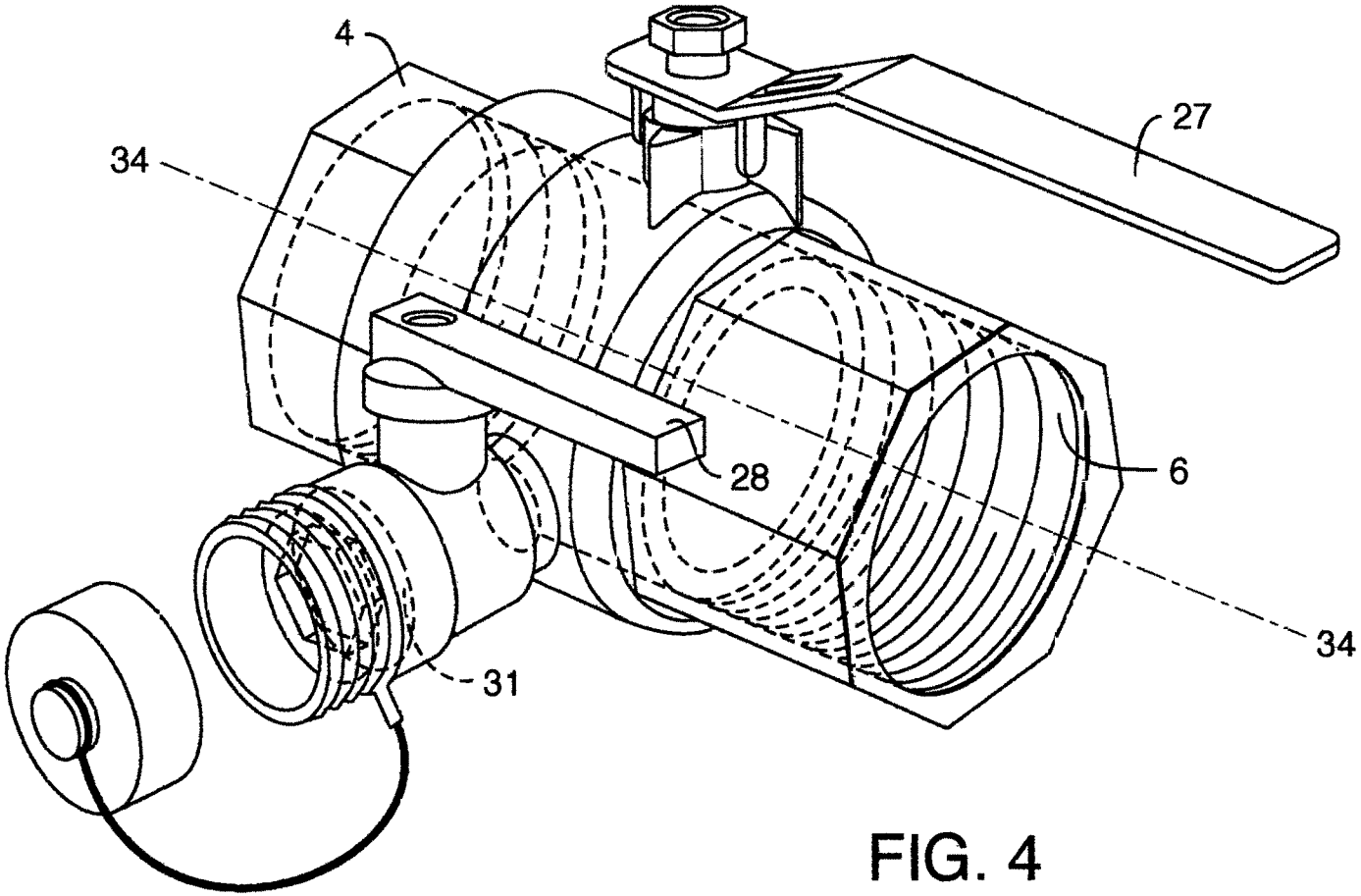
FIG. 4 shows a second perspective view of the first three way purge fluid isolation valve unit of the invention seen in FIG. 3.
Figure 5:
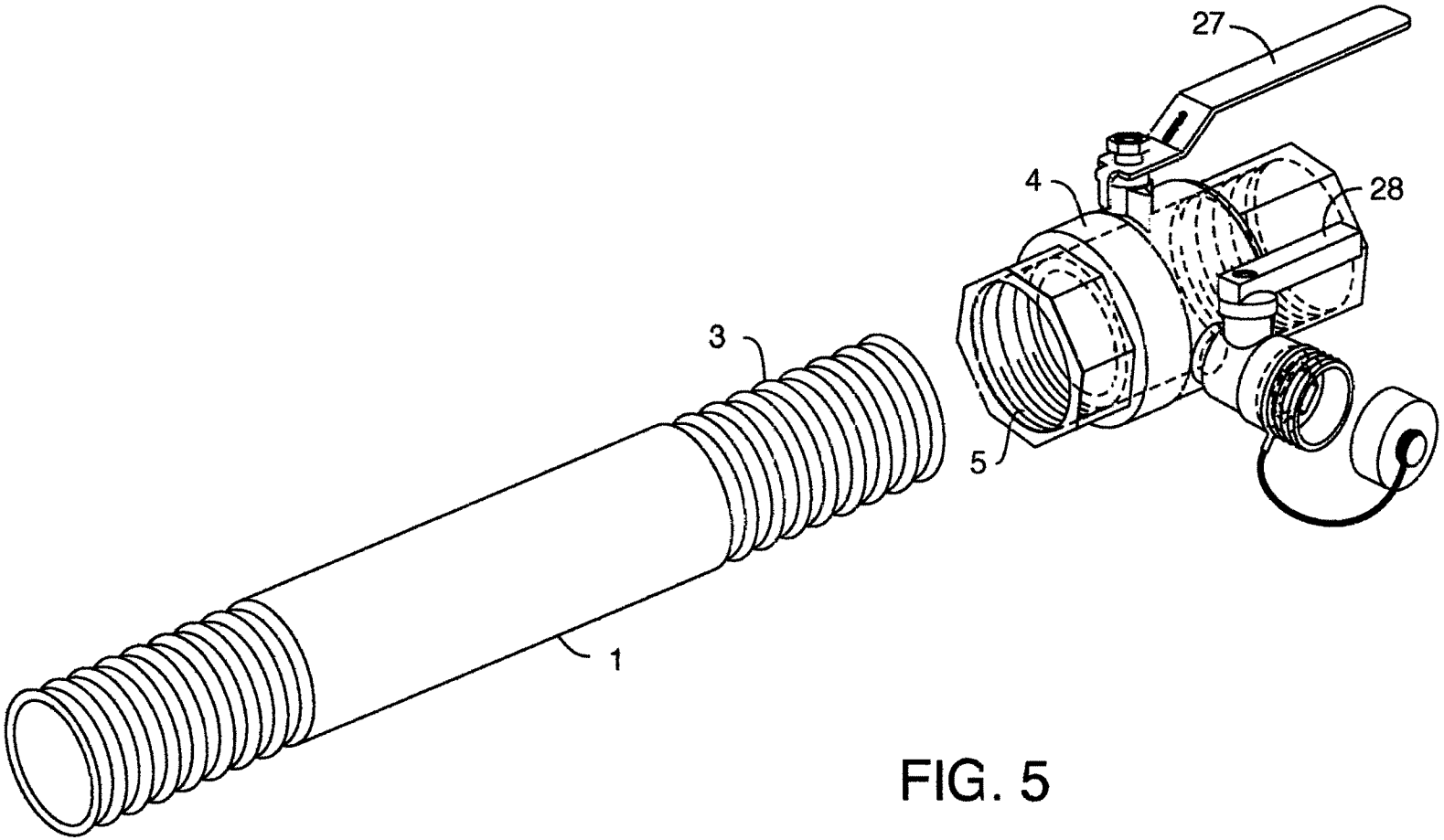
FIG. 5 shows the first piping component with externally threaded second end thereof in apposition to the first end cavity of the first three way purge fluid isolation valve unit as shown in FIG. 3.
Figure 7:
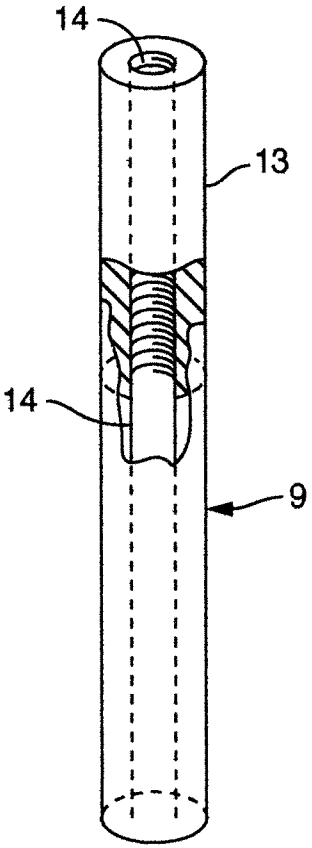
FIG. 7 shows in plan view the partially hollow stem portion of the T-shaped piping unit of the invention.
Figure 6:
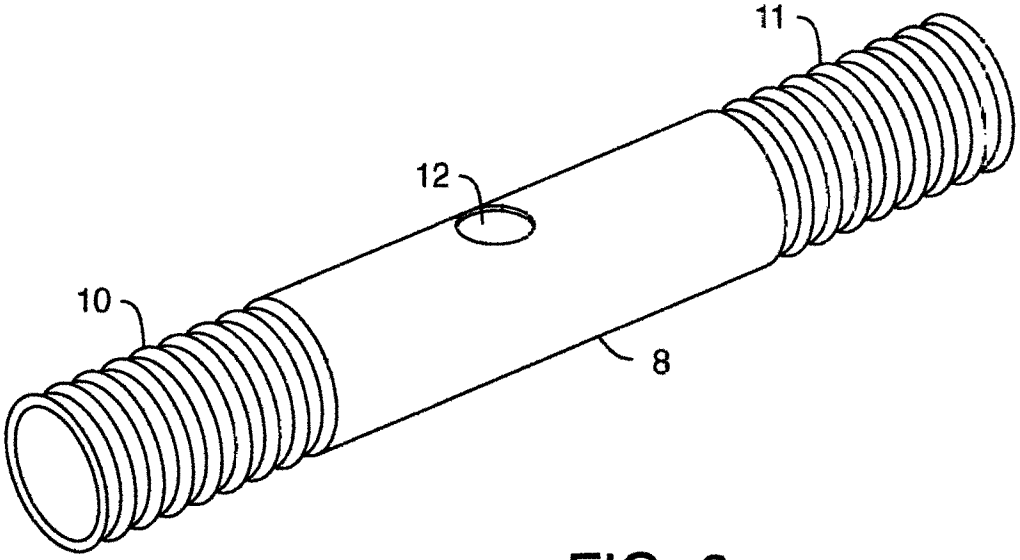
FIG. 6 shows in perspective view the hollow crossbar portion of the T-shaped piping unit of the invention.
Figure 8:
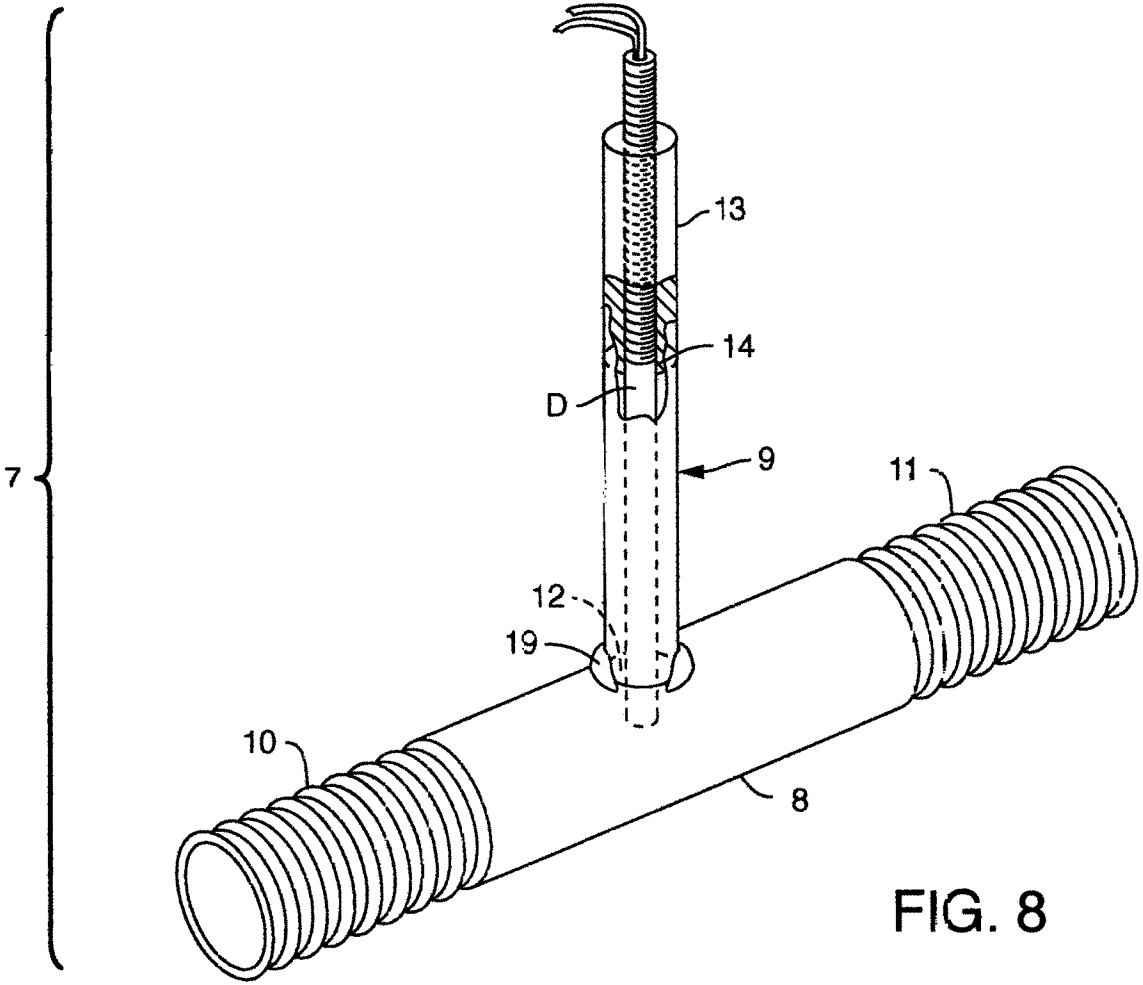
FIG. 8 shows the fully intact T-shaped piping unit of the invention.
Figure 9:
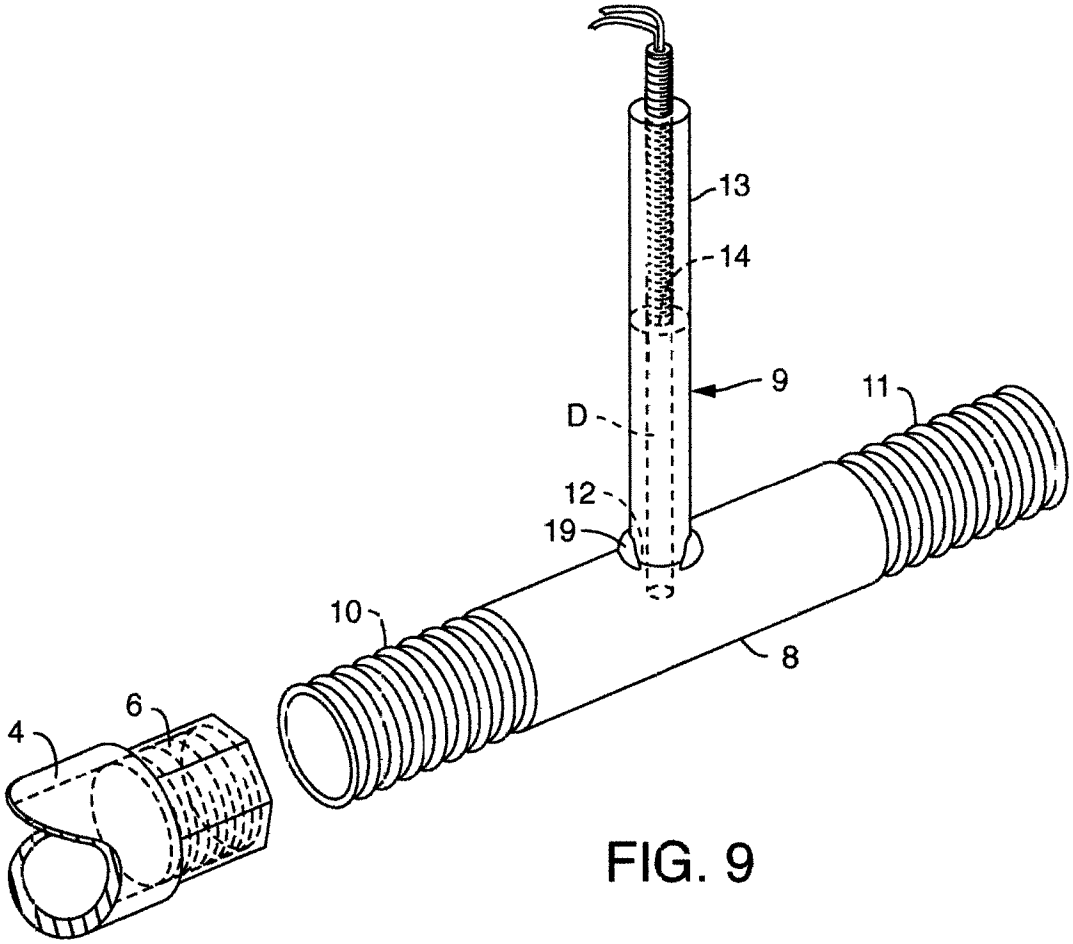
FIG. 9 shows the first end segment of the crossbar portion of the T-shaped piping unit of the invention in apposition to the second end cavity of the first three way purge fluid isolation valve unit of the invention as shown in FIG. 4.
Figure 10:
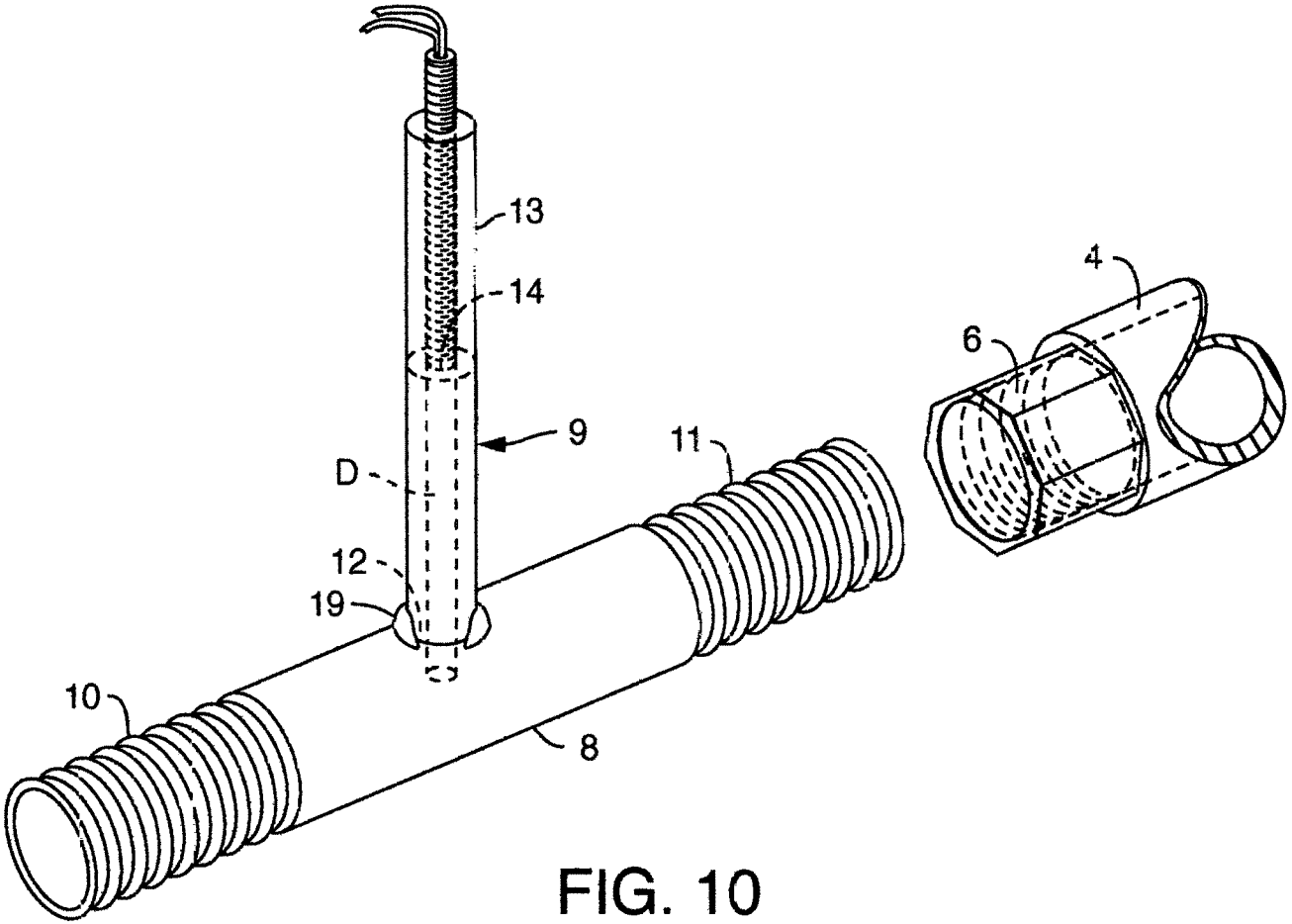
FIG. 10 shows the second end segment of the crossbar portion of the T-shaped piping unit of the invention in apposition to the second end cavity of the second three way purge fluid isolation valve unit of the invention.
Figure 11:
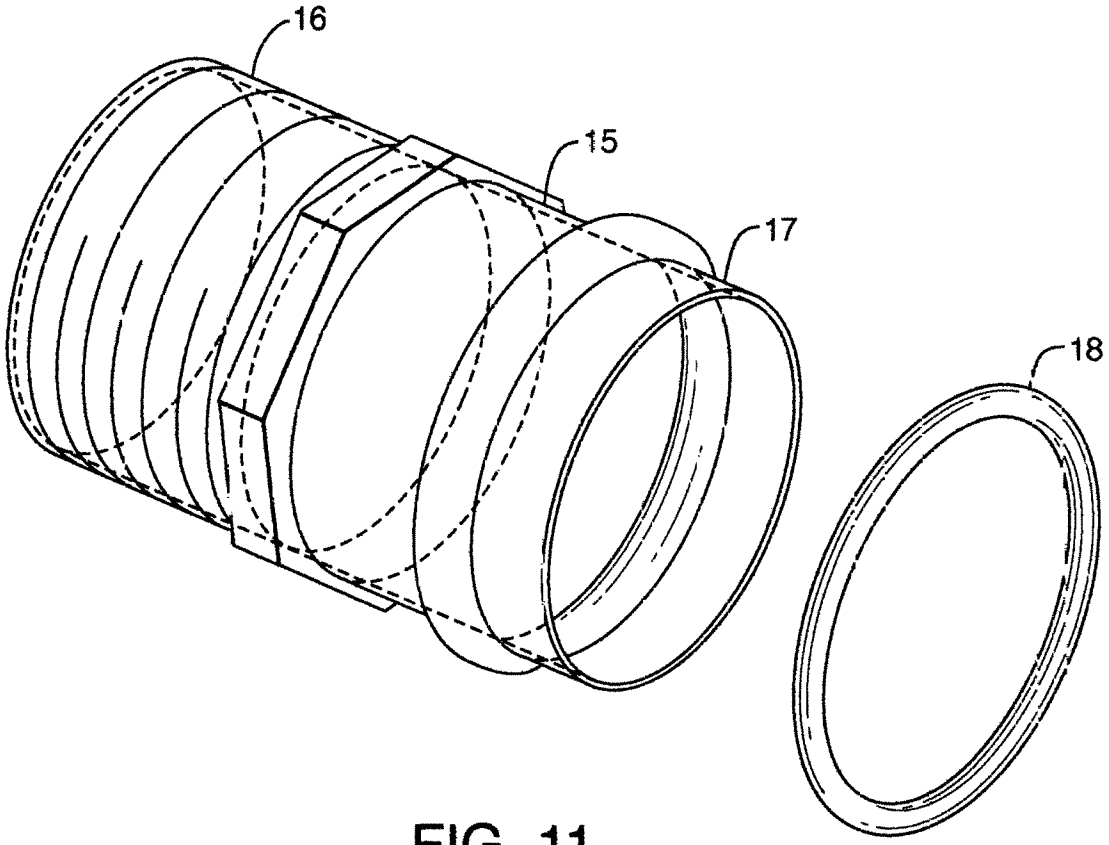
FIG. 11 shows the adapter unit of the invention.
Figure 12:
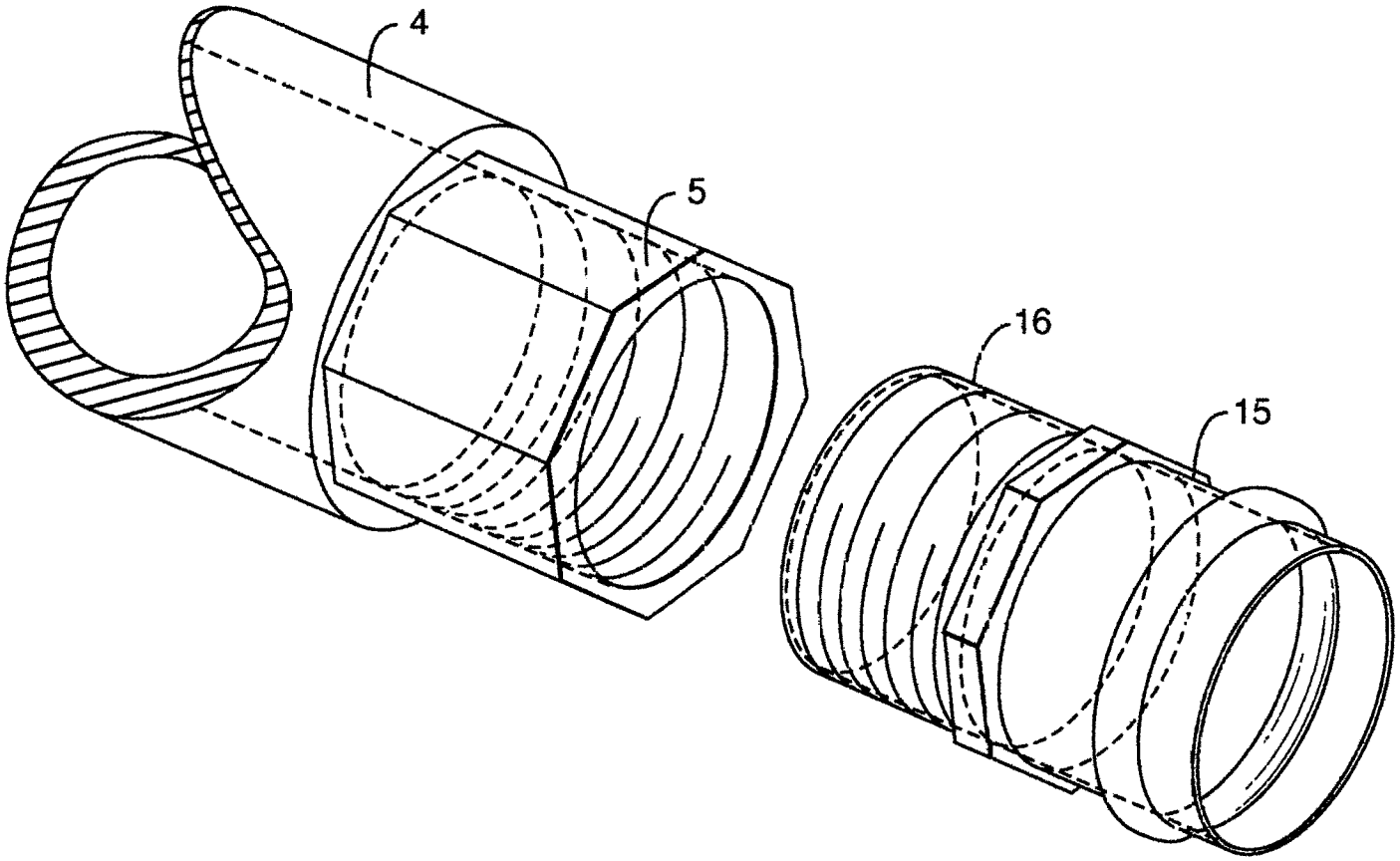
FIG. 12 shows the first end portion of the adapter unit in apposition to the first end cavity of the second three way purge fluid isolation valve unit of the invention.
Figure 13:
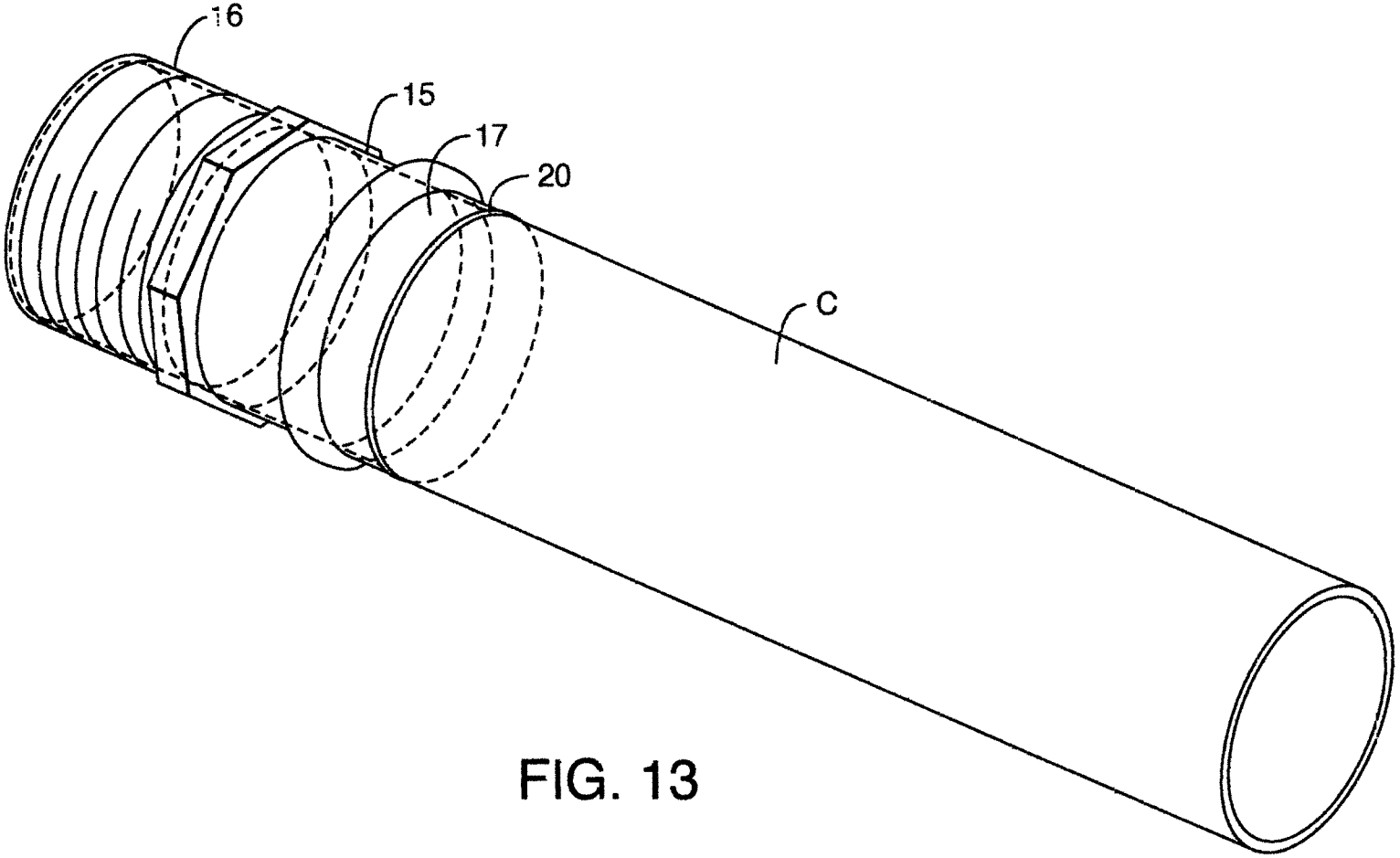
FIG. 13 shows the second end portion of the adapter unit in apposition to outflow piping.
Figure 14:
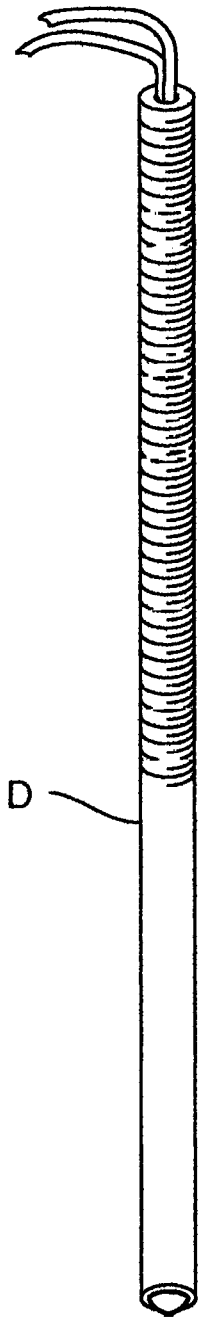
FIG. 14 shows a lower water sensor unit.

FIGS. 1 and 2 reflect respectively the initial piping units of the first and second embodiments of the invention. FIG. 1 shows a hot water boiler A within which there is an internally threaded hole B in the topside thereof in apposition to the first piping component 1 of the invention. FIG. 2 shows a hot water boiler A with an internally threaded hole B found in one lateral side thereof and in apposition to an ancillary piping component 21 with externally threaded first end segment 22 and externally threaded second end segment 23 in turn in apposition to elbow shaped fitting component 24 with internally threaded first end portion 25 and internally threaded second end portion 26 in turn in apposition to first piping component 1 with first end segment 2 and second end segment 3. As respects the first embodiment, externally threaded first end segment 2 of piping component 1 is threadably connected to boiler unit A via turning first end segment 2 thereof into hole B of unit A located in the topside of unit A. As respects the second embodiment of the invention, externally threaded first end segment 22 of piping component 21 is similarly, threadably connected into hole B in one lateral side of unit A. Then internally threaded first end portion 25 of elbow unit 24 is threadably connected to externally threaded second end segment 23 of piping component 21. The first end segment 2 of piping component 1 is threadably connected to internally threaded second end portion 26 of elbow unit 24 and with respect to all of what follows, there is no distinction as between the first and second embodiments of the invention. The first embodiment accommodates the existence of a hole B in the topside of boiler unit A. The second embodiment accommodates the existence of a hole B in one lateral side of a boiler unit A. Hollow piping component 1 by itself as described above or hollow piping component 1 conjoined with elbow shaped fitting component 24 in turn conjoined with ancillary piping component 21 serve equivalently as an initial piping unit with external threading about each extreme end segment thereof. FIG. 3 shows, in first perspective view, the first one of the two three way purge fluid isolation valve units 4 of the invention. FIG. 3 also shows an internally threaded first end cavity portion 5 of this first three way purge valve unit 4. FIG. 4 shows in second perspective view the second end cavity portion 6 of unit 4. Cavity portion 6 as does cavity portion 5 is also characterized by the presence of internal threading about the inner walling thereof. As can be noted with reference to FIG. 5, externally threaded end 3 of hollow first piping component 1 provides the manner in which component 1 is threadably connected to unit 4 within cavity portion 5. FIG. 6 shows the hollow crossbar portion 8 of the T-shaped piping unit 7 of the invention. Crossbar portion 8 has a through hole 12 located therein. Hole 12 has a clearance sufficient to receive the body of a sensor unit D. Crossbar portion 8 also features an externally threaded first end 10 and an externally threaded second end 11. FIG. 7 shows the partially hollow stem portion 9 of piping unit 7. Stem portion 9 has a solid base section 13 within which there is an internally threaded through hole 14. Through hole 14 has a clearance sufficient enough to threadably receive and accordingly hold externally threaded sensor unit D. Unit D is shown in FIG. 14. Stem portion 9 so threadably holding sensor unit D, as seen with reference to FIG. 7, is then conjoined with crossbar portion 8 at and about hole 12 after insertion therein of the upper end of sensor unit D, all via first affixation means 19. First affixation means 19 can be either a solder material or a weld. Soldering is the preferred manner of such affixation as respects relatively small diameter copper or brass fittings utilized, for example, within residential home structures. Welding is the preferred manner of such affixation as respects relatively large diameter, stainless steel fittings utilized, for example, within large commercial buildings. FIG. 8 shows an intact T-shaped piping unit 7 once stem portion 9 is so affixed to crossbar portion 8 at and about the location of hole 12 in crossbar portion 8. FIG. 9 shows the manner in which first end segment 10 of crossbar portion 8 is threadably connected to the first three way purge fluid isolation valve unit 4 by way of threadable connection of end segment 10 to the internal threading about the inner walling of second end cavity portion 6 of unit 4. FIG. 10 shows externally threaded second end segment 11 of crossbar portion 8 in apposition to second end cavity portion 6 of the second three way purge fluid isolation valve unit 4 of the invention. Second end segment 11 is threadably connected to second unit 4 via the internal threading about the inner walling of cavity portion 6 thereof. FIG. 11 shows the adapter unit 15 of the invention. Unit 15 features an externally threaded first end portion 16 and a second end portion 17. Unit 15 is hollow throughout. FIG. 12 shows first end portion 16 of unit 15 in apposition to the first end cavity portion 5 of the second three way purge fluid isolation valve unit 4 of the invention. The external threading about first end portion 16 is amenable to being received by the internal threading about the inner walling of cavity portion 5 of second valve unit 4 so as to thereby threadably connect unit 15 to second valve unit 4. FIG. 13 shows second end portion 17 of unit 15 in apposition to the proximal end portion of outflow piping C. Second affixation means 20 also seen in FIG. 13 serves to facilitate affixation of second end portion 17 to the proximal end portion of outflow piping C. Second affixation means 20 can be either a solder material for small diameter copper or brass fittings found, as noted above, typically within residential structures or a weld for larger diameter stainless steel fittings found in large commercial buildings. An optional O-ring 18 also seen in FIG. 11 would serve to facilitate pressurized press fitting of outflow piping C within end portion 17 of unit 15 as an alternative affixation means 20 for purposes of affixing unit 15 to the proximal end portion of outflow piping C. FIG. 14 shows a low water sensor unit D.

The word, "fittings as utilized above refers to: first piping unit 1, ancillary piping component 21 and elbow unit 24 along with T-shaped piping unit 7 including its crossbar portion 8 and stem portion 9 as well as adapter unit 15.

Figure 15:
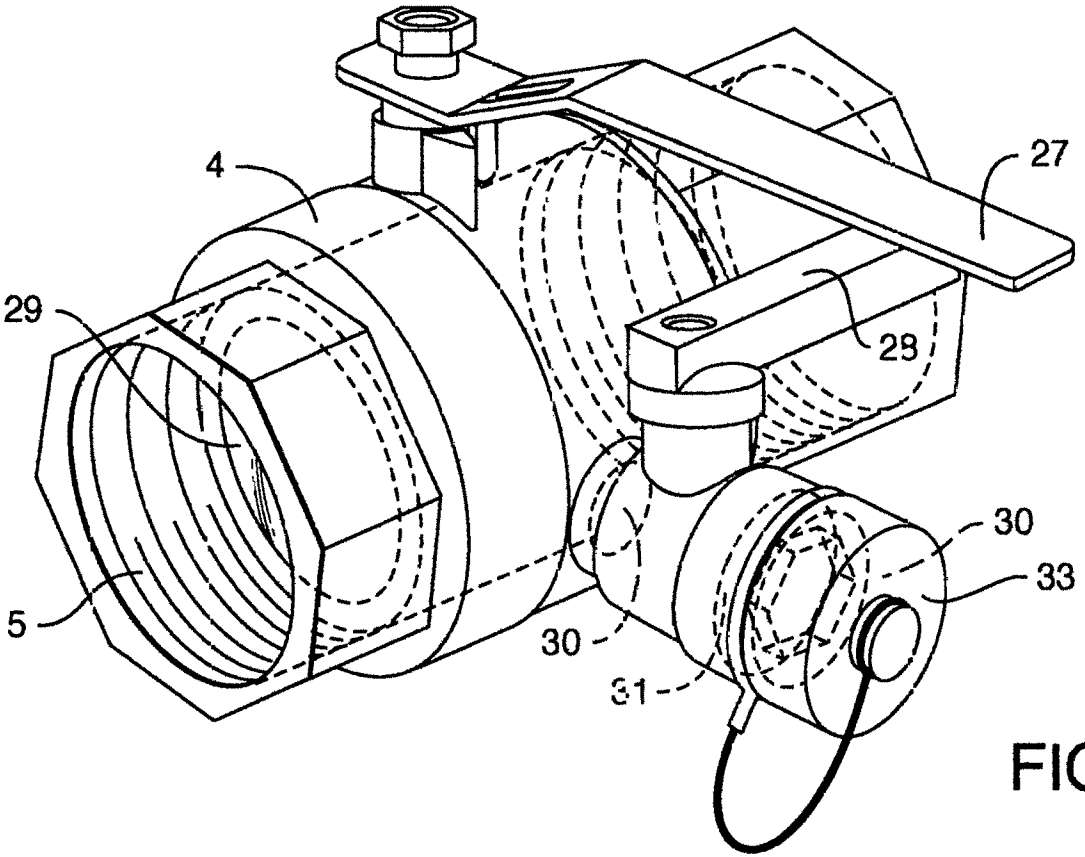
FIG. 15 shows the first water stop element within the accordingly closed first end cavity of the first three way purge fluid isolation valve unit of the invention.
Figure 16:
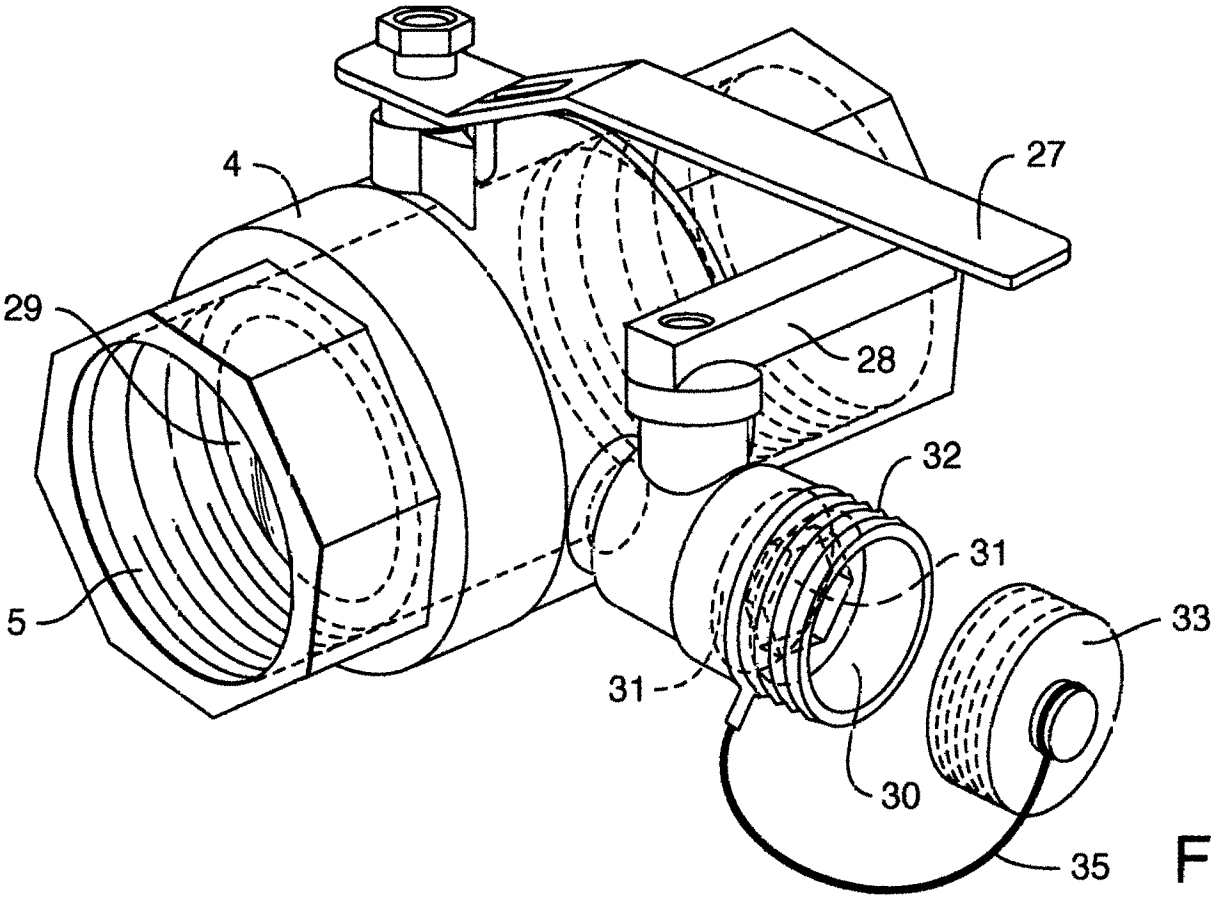
FIG. 16 shows in isolated perspective view the second water stop element and accordingly closed third end cavity of the first three way purge fluid isolation valve unit of the invention.
Figure 17:
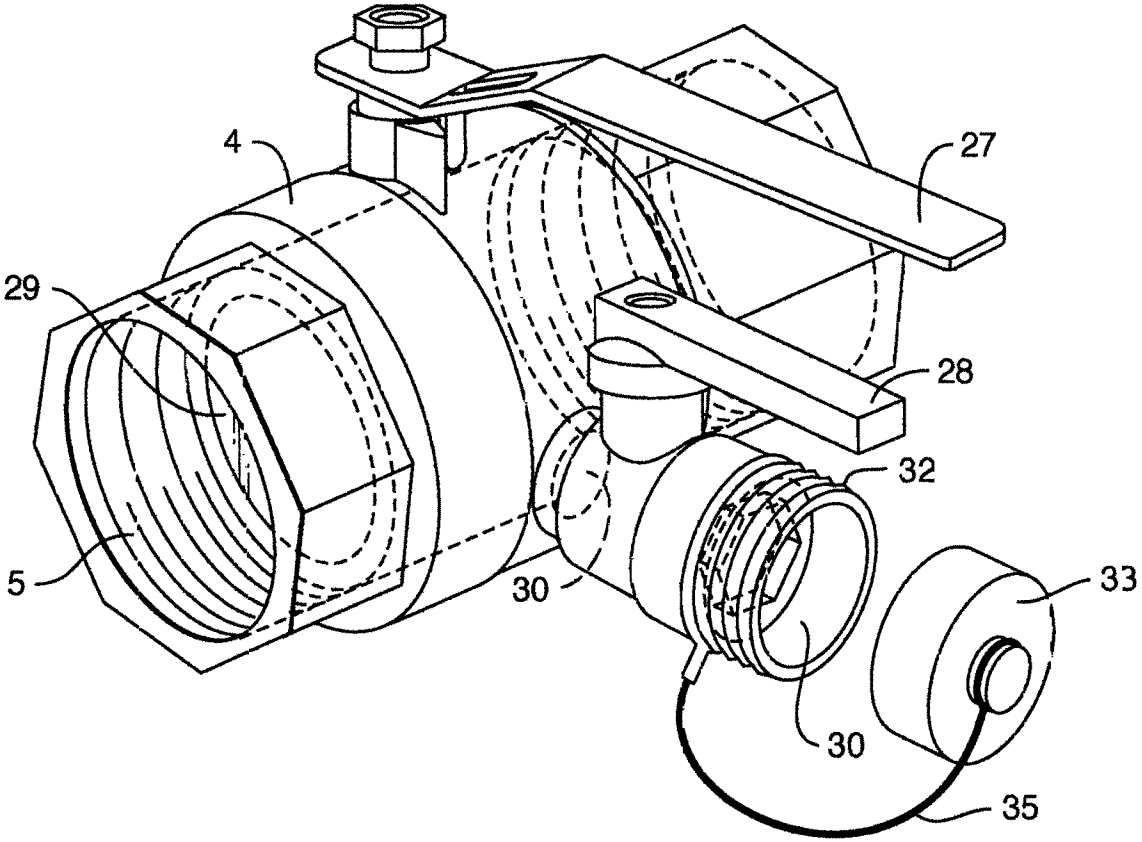
FIG. 17 shows in isolated perspective view the third open end cavity of the first three way purge valve fluid isolation unit of the invention.
Figure 18:
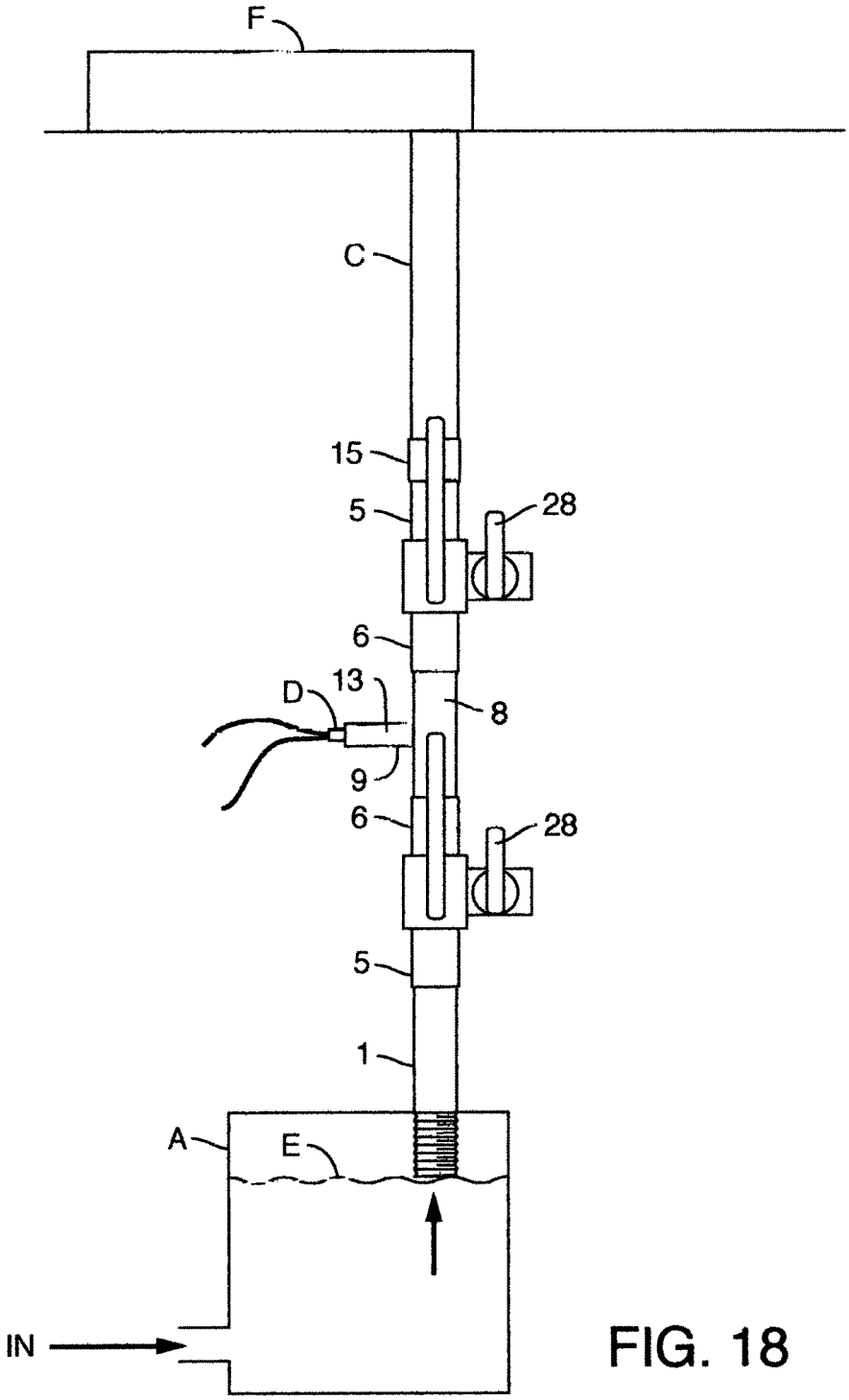
FIG. 18 shows, in schematic plan view, the fully assembled first embodiment of the invention affixed to a boiler and also to outflow piping.
Figure 19:
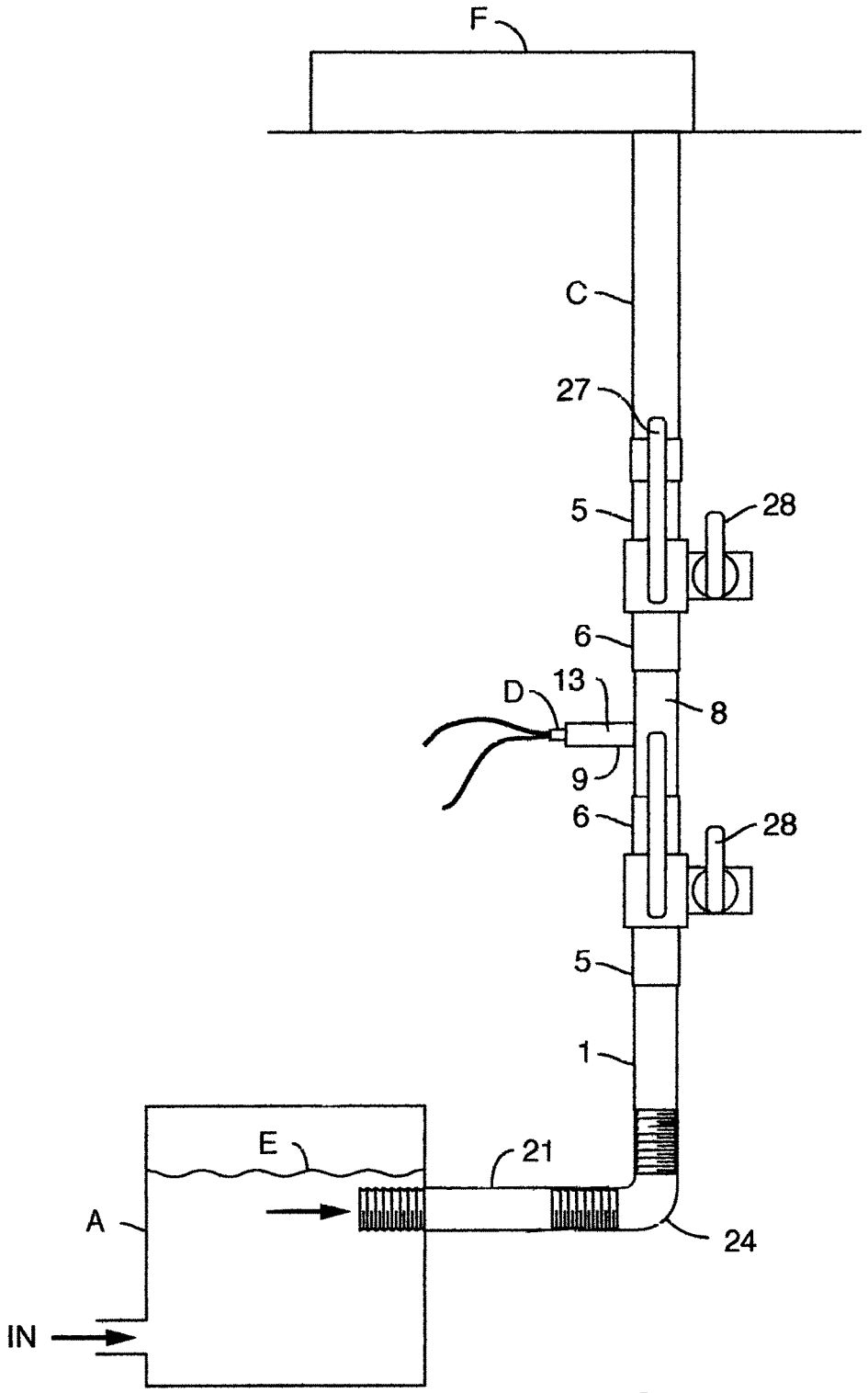
FIG. 19 shows, in schematic plan view, the fully assembled second embodiment of the invention affixed to a boiler and also to outflow piping.

FIG. 18 schematically shows the fully assembled first embodiment of the invention affixed to both a boiler A and the proximal end of outflow piping C. FIG. 19 schematically shows the fully assembled second embodiment of the invention affixed to both a boiler A and the proximal end of outflow piping C. FIGS. 15, 16 and 17 serve to illustrate the manner in which the invention serves the purpose of facilitating very quick and easy testing of the integrity of a low water level sensor unit D.

To begin with, in such respects, once again, FIGS. 3 and 4 show the first three way purge fluid isolation valve unit 4. First unit 4 is exactly the same as, second three way purge fluid isolation valve unit 4. Each of both three way purge fluid isolation valve units 4 features a first valve handle 27 and a second valve handle 28. Each unit 4 also has an elongated third end cavity portion 30 with external threading 32 about the outer walling of the end portion thereof. Also, internally threaded cap component 33 is optionally also attached to the body of each unit 4 as well by way of wiring or string material 35 as seen in e.g. FIG. 16. Cavity portion 30, external threading 32 and affixed cap component 33 are shown in e.g. FIG. 16. FIGS. 3 and 4 show valve handles 27 and 28, each being horizontally inclined and positioned parallel to the lie of the long central axis 34 of each unit 4 as is seen in FIG. 3. When valve handles 27 and 28 are so inclined, then cavity 5 and cavity 6 of each are patent, that is to say open to each other thereby allowing for the free flow of hot water E seen in FIGS. 1 and 2 from boiler A through the initial piping unit of either embodiment of the invention through cavity 5 and cavity 6 of first unit 4 and through hollow crossbar portion 8 past a therein held sensor D and in turn through cavity 6 and cavity 5 of second unit 4 and then the adapter unit 15 and ultimately into outflow piping C and lastly to outlying various heating elements F within the building structure housing the boiler unit A. Elements F are shown in FIGS. 18 and 19. Such free flow is however accomplished, since, when second valve handle 28 is likewise so positioned, then the third end cavity portion 30 of first unit 4 is closed to the free flow of any water E as is, as well, third end cavity portion 30 of second unit 4. Such a closed state of third end cavity portion 30 is as is shown in FIGS. 3, 4 and 16. Such closure of the third end cavity portion 30 of each of the units 4 is as the result of the presence within each cavity 30 of a second water stop element 31 shown in FIGS. 15 and 16 and connected to the second valve handle 28 in respect of each unit 4 about and within the respective cavities 30 of each in such a manner that rotation of a valve handle 28 through an angle of 90° from the horizontal position parallel to the lie of axis 34 causes a recession of the water stop element 31 from a position thereof serving to keep a cavity portion 30 completely closed to a position whereby that cavity portion 30 is then wholly open. FIG. 17 shows the recessed state of second water stop element 31 within a cavity portion 30 serving to keep open that cavity portion 30 to the free flow of any water E. Also, when the cavity portion 30 is closed as respects each of the units 4, the internally threaded cap 33 of each is typically threadably connected to the externally threaded end portion outer walling 32 of the cavity portion 30 of each unit 4 as seen in FIG. 15 FIGS. 3 and 4 show open cavities 5 and 6 and further illustrate in conjunction with FIG. 15, closed third end cavity portion 30 as respects the matter of the free flow of water E shown in FIG. 1 from boiler unit A through hole B, through each of the various parts of the invention and ultimately into outflow piping C seen, e.g., in FIG. 13. Once again, it will be noted that in such a state, handles 27 and 28 are both horizontally and parallel wise inclined with reference to the lie of the long central axis 34 of each unit 4.

Now then when any testing of the integrity of a sensor unit D is sought to be attempted, all that is required is initially a simple rotation of handle 27 of first unit 4 and handle 27 of second unit 4, each through an angle of 90°. This amount of such rotation serves to then completely close the first end cavity portion 5 of each of the units 4 to any further free flow of water E. Such closure is accomplished by virtue of the presence of a first water stop element 29 within each cavity 5 that is itself connected to the handle 27 of each of the units 4 in such a manner that rotation of a valve handle 27 through an angle of 90° from an initially horizontal position as shown in FIG. 3 to that shown in FIG. 15 causes an advancement of the water stop element 29 from a position theretofore serving to keep a cavity 5 completely open to a position whereby that cavity 5 is then wholly closed. FIG. 15 illustrates the post rotation presence of such a water stop element 29 within a closed cavity 5 of either one of the units 4 of the invention. Once the above said rotational step will have been taken, then the free flow of water E from a boiler A into and through cavity 5 of first unit 4 and ultimately into crossbar portion 8, etc., will have been wholly impeded. Likewise, perforce of a similar rotational step taken as respects second unit 4, the free flow of water E within outflow piping C back through cavity 5 of second unit 4 will have been similarly wholly impeded. At this juncture, there will be static water E trapped within first unit 4, T-shaped piping unit 7 and second unit 4. It then remains for the person conducting the testing of the integrity of a sensor unit D to then simply rotate each handle 28 of each of first unit 4 and second unit 4 each through an angle of 90°. This amount of such rotation serves to then cause recession of the second water stop element 31 within each cavity 30 of each unit 4 of the invention such that the cavity 30 of each is then wholly open as shown in FIG. 17. The cap 33 about the external walling of each cavity 30 is then threadably removed therefrom with the result then being that air enters through the then open cavity 30 of second unit 4 and assists gravity in terms of effecting the flowage of all of the just previously trapped water E out through the then open cavity 30 of first unit 4. The end effect of these two very brief rotational undertakings is the creating of wholly empty space about a sensor unit D held within T-shaped piping unit 7 thereby mimicking the situation that would attend any actual low water event within a boiler A whereby the ready flow of water E out of a boiler A through a hole B, etc, would, for whatever reason, have been compromised. If the so held sensor unit D is properly functioning, it will then cause the boiler A to promptly be powered off. If, on the other hand, the so held sensor unit D is, itself, then dysfunctional, then there will then be no powering off of the boiler A and it will be readily known that the sensor unit D is then in need of prompt replacement. Finally, once such testing will have been accomplished, then each cap 33 is threadably connected once again about the external walling of each cavity 30. Then each handle 28 is easily rotated back through 90° to thereby reinstate water stop element 31 serving to completely close each cavity 30 and then each handle 27 is easily rotated back through 90° to thereby cause recession of each water stop element 29 within each cavity 5 thereby facilitating once again the free flow of water E from a boiler A ultimately to and into outflow piping C.

As will be readily noted with reference to the foregoing discussion, the invention provides a very quick, easy and highly economical way of testing the integrity of sensor unit D by just one person as opposed to having two persons working over a prolonged period of time to completely drain all of the water E from outflow piping C and a boiler A to then test the integrity of a sensor unit D and then after having done so to then take yet a goodly amount of more time to then refill the whole system with water E once testing would have been accomplished.

In view of the whole of the foregoing, respectfully submitted, the invention as now shown and described is not merely new, useful and unique, but is rather veritably revolutionary in terms of the matter of an intermittently and now very quickly and easily testing of the integrity of a low water sensor unit D.

What is claimed is:

1. A low water sensor testing device, comprising:

a. an initial piping unit;

b. said initial piping unit being made up of a hollow, elongated ancillary piping component, a hollow elbow shaped fitting component and a hollow elongated first piping component;

c. said ancillary piping component having an externally threaded first end segment and an externally threaded second end segment;

d. said elbow shaped fitting component having internal threading within a first end segment thereof;

e. said elbow shaped fitting component having internal threading within a second end segment thereof;

f. said first piping component having an externally threaded first end segment and an externally threaded second end segment;

g. said second end segment of said ancillary piping component being threadably connected within said first end segment of said elbow shaped fitting component;

h. said first end segment of said first piping component being threadably connected within said second end segment of said elbow shaped fitting component;

i. a first three way purge fluid isolation valve unit;

j. an internally threaded first end cavity portion of said first valve unit;

k. said second end segment of said first piping component being threadably connected within said first end cavity portion of said first valve unit;

l. an internally threaded second end cavity portion of said first valve unit;

m. a T-shaped piping unit;

n. a hollow crossbar portion of said T-shaped piping unit;

o. an externally threaded first end segment of said crossbar portion;

p. said externally threaded first end segment of said crossbar portion being threadably connected within said second end cavity portion of said first valve unit;

q. an externally threaded second end segment of said crossbar portion;

r. a partially hollow stem portion of said T-shaped piping unit;

s. a through hole in said crossbar portion with a clearance sufficient to accept an elongated cylindrically shaped, externally threaded sensor unit;

t. a partially hollow stem portion of said T-shaped piping unit;

u. first affixation means for conjoining said stem portion to said crossbar portion at a locus of said through hole;

v. a solid base section of said stem portion;

w. an elongated internally threaded through hole within said base section with a clearance sufficient to accept an elongated, cylindrically shaped, externally threaded sensor unit;

x. a second three way purge fluid isolation valve unit;

y. an internally threaded first end cavity portion of said second valve unit;

z. an internally threaded second end cavity portion of said second valve unit;

aa. said second end segment of said crossbar portion being threadably connected within said second end cavity portion of said second valve unit;

bb. a hollow adapter unit;

cc. an externally threaded first end portion of said adapter unit;

dd. said first end portion of said adapter unit being threadably connected within said first end cavity portion of said second valve unit;

ee. a hollow second end portion of said adapter unit;

ff. second affixation means for conjoining a proximal end portion of outflow piping to inner walling of said hollow second end portion of said adapter unit, and;

gg. said externally threaded first end segment of said ancillary piping component being threadably connected to an internally threaded hole in a lateral side of a hot water boiler unit.

2. The low water sensor testing device of claim 1, whereby said first affixation means is a solder material.

3. The low water sensor testing device of claim 1, whereby said first affixation means is a weld.

4. The low water sensor testing device of claim 1, whereby said second affixation means is a solder material.

5. The low water sensor testing device of claim 1, whereby said second affixation means is a weld.

6. The low water sensor testing device of claim 1, whereby said second affixation means is a press fitted connection featuring an O-ring unit fitted within said hollow second end portion of said adapter unit.

7. A low water sensor testing device, comprising:

a. an initial piping unit;

b. said initial piping unit being made up of a hollow elongated first piping component;

c. said first piping component having an externally threaded first end segment and an externally threaded second end segment;

d. a first three way purge fluid isolation valve unit;

e. an internally threaded first end cavity portion of said first valve unit;

f. said second end segment of said first piping component being threadably connected within said first end cavity portion of said first valve unit;

g. an internally threaded second end cavity portion of said first valve unit;

h. a T-shaped piping unit;

i. a hollow crossbar portion of said T-shaped piping unit;

j. an externally threaded first end segment of said crossbar portion;

k. said externally threaded first end segment of said crossbar portion being threadably connected within said second end cavity portion of said first valve unit;

l. an externally threaded second end segment of said crossbar portion;

m. a partially hollow stem portion of said T-shaped piping unit;

n. a through hole in said crossbar portion with a clearance sufficient to accept an elongated cylindrically shaped, externally threaded sensor unit;

o. a partially hollow stem portion of said T-shaped piping unit;

p. first affixation means for conjoining said stem portion to said crossbar portion at a locus of said through hole;

q. a solid base section of said stem portion;

r. an elongated internally threaded through hole within said base section with a clearance sufficient to accept an elongated, cylindrically shaped, externally threaded sensor unit;

s. a second three way purge fluid isolation valve unit;

t. an internally threaded first end cavity portion of said second valve unit;

u. an internally threaded second end cavity portion of said second valve unit;

v. said second end segment of said crossbar portion being threadably connected within said second end cavity portion of said second valve unit;

w. a hollow adapter unit;

x. an externally threaded first end portion of said adapter unit;

y. said first end portion of said adapter unit being threadably connected within said first end cavity portion of said second valve unit;

z. a hollow second end portion of said adapter unit;

aa. second affixation means for conjoining a proximal end portion of outflow piping to inner walling of said hollow second end portion of said adapter unit, and;

bb. said externally threaded first end segment of said first piping component being threadably connected to an internally threaded hole in a topside of a hot water boiler unit.

8. The low water sensor testing device of claim 7, whereby said first affixation means is a solder material.

9. The low water sensor testing device of claim 7, whereby said first affixation means is a weld.

10. The low water sensor testing device of claim 7, whereby said second affixation means is a solder material.

11. The low water sensor testing device of claim 7, whereby said second affixation means is a weld.

12. The low water sensor testing device of claim 7, whereby said second affixation means is a press fitted connection featuring an O-ring unit fitted within said hollow second end portion of said adapter unit.

* * * * *